United States Patent [19]

Goris et al.

[11] 4,239,290

[45] Dec. 16, 1980

[54] HYDROMECHANICAL PLANER WITH CUTTING AND BREAKING HEADS

[75] Inventors: Heinrich Goris, Hamminkeln; Roland Günther, Wesel; Kurt Ogorek, Oberhausen; Karl-Heinz Schwarting, Voerde, all of Fed. Rep. of Germany

[73] Assignee: Gutehoffnungshütte Sterkrade Aktiengesellschaft, Fed. Rep. of Germany

[21] Appl. No.: 56,842

[22] Filed: Jul. 12, 1979

[30] Foreign Application Priority Data

Jul. 22, 1978 [DE] Fed. Rep. of Germany ..... 2832319

[51] Int. Cl.[3] ..... E21C 27/34; E21C 25/60

[52] U.S. Cl. ..... 299/34; 299/17; 299/81

[58] Field of Search ..... 299/17, 32, 34, 81

[56] References Cited

U.S. PATENT DOCUMENTS

| | | | |
|---|---|---|---|
| 1,637,531 | 8/1927 | Morgan | 299/32 X |
| 1,637,783 | 8/1927 | Morgan | 299/34 |
| 1,710,887 | 4/1929 | Morgan | 299/32 X |
| 2,666,629 | 1/1954 | Sproul | 299/32 |
| 3,361,479 | 1/1968 | Lobbe | 299/34 |

FOREIGN PATENT DOCUMENTS

| | | | |
|---|---|---|---|
| 2713781 | 10/1978 | Fed. Rep. of Germany | 299/34 |

*Primary Examiner*—Ernest R. Purser

*Attorney, Agent, or Firm*—McGlew and Tuttle

[57] ABSTRACT

A hydromatic planer particularly for mining materials in a mining seam comprises a planer housing which advantageously has a cutting and breaking head on each end thereof, each of which includes a substantially identical construction. Each cutting head includes a vertically arranged support member which is mounted on the housing of the planer by a parallel linkage so that it may be moved upwardly and downwardly under the control of an adjustment means such as a fluid pressure operated piston and cylinder combination. Each cutting and breaking head also includes a first substantially vertically arranged support member which is connected by the linkage for upward and downward movement relative to the housing and a second support member which is movable relative to the first and mounted on this first in vertical guides for upward and downward movement. A second fluid pressure operated piston and cylinder combination is connected between first and second support members so that they may be shifted relative to each other. A second support member advantageously carries a cutting and breaking wedge which is oriented to engage the mining seam, for example, on a side thereof, and which may be adjusted relative to a similarly oriented cutting and breaking wedge carried by the first member. In addition, a separate cutting and breaking wedge is carried by the first member and it may be engaged for example against the floor thereof in a plane different from the other two wedges.

19 Claims, 13 Drawing Figures

HYDROMECHANICAL PLANER WITH CUTTING AND BREAKING HEADS

BACKGROUND OF THE INVENTION

Field of the Invention

This invention relates in general to a mining device, in particular, to a new and useful hydromatic planer which includes a cutting and breaking head on each side of a housing which may be adjustedly positioned relative to a mining seam and which carries a plurality of separate cutting and breaking wedges which may be shifted upwardly and downwardly relative to each other and which are oriented to cut separate planes which also include a a nozzle pivotly mounted thereon which may be moved so as to cut away the mining seam by forcing a jet of water thereagainst.

The present invention is an improvement over that disclosed in application Ser. No. 890,953 filed by the present inventors on Mar. 28, 1978 and now U.S. Pat. No. 4,181,363. The present invention provides an improved cutting and breaking head construction of a planer in which there are a plurality of separate cutting and breaking wedges which are mounted for movement relative to each other and for arrangement in at least two separate working planes for the cutting away of material therefrom.

SUMMARY OF THE INVENTION

The invention is directed to a design of the cutting and breaking tools of the hydromechanical planer, ensuring that:

The mineral is cut continuously in coordinated cutting and breaking operations, so that the power supply of the planer is minimized even during the extraction of a very hard mineral;

The cut on the face, roof, and floor results in smooth surfaces, so that the advancing support can follow the advance of the face without hindrance;

The extracted mineral is transferred to the discharge means through a sufficiently clear space;

The planer can be adjusted to the pace of advance in a most simple manner;

The planer can be adjusted to the seam thickness with simple means without disturbing the continuous extracting operation;

The sensitive parts of the hydromechanical planer are protected to the largest extent; and The planer can be readjusted to a cut in the opposite direction automatically and in a minimum period of time.

One cutting and breaking head, comprising supported elements and cutting and breaking wedges, is mounted on each front side of the planer.

To make a cut in one direction, the cutting and breaking wedges of the respective front side must be brought into contact with the seam to be worked, that is, brought into their working position, while the cutting and breaking wedges on the opposite front side must be kept clear from the seam, that is, be in their rest position. To make the next cut in the opposite direction, an opposite position of the cutting and breaking wedges is needed.

To utilize the planer to its full capacity, the cutting and breaking wedges must engage into the seam and the mineral slabs must be broken away as far as possible automatically.

While utilizing the adjustability of the coupling elements and of the supporting elements coupled thereto, this requirement is met, in accordance with the invention, by designing the supporting elements in two parts, namely as a fixed supporting element, and a movable supporting element displaceable therein, and the movable supporting element is adjustable in height by means of an adjusting element.

The vertical displacement of the movable supporting element relative to the fixed supporting element is made possible, in accordance with the invention, by providing projections on the movable supporting element which are displaceable in corresponding guides of the fixed supporting element and can there be adjusted in height and held in their position.

Both the fixed and the movable elements carry each a cutting and breaking wedge, which also can be fixed at a level corresponding to the thickness of the seam.

This is made possible, in accordance with one feature of the invention, by providing guides in the cutting and breaking wedge designed for receiving clamping and guiding elements which can be connected to the fixed or the movable supporting element by means of securing elements.

To be able to advance the conveyor means in step with the working face and without problems, the hydromechanical planer must cut a smooth floor.

This is insured, in accordance with the invention, by providing a cutting and breaking wedge turned through 90° and mounted below the fixed supporting element, by which the mineral left in the floor is cut smoothly away in a substantially horizontal plane.

To shift the advancing support without troubles, the hydromechanical planer must cut the roof smoothly too. This is made possible, in accordance with the invention, by providing exchangeable and adjustable breaking tools which are mounted on the movable supporting element and break away the remaining mineral protruding from the roof.

The same applies to the working face where no mineral rib must be left between the roof and the floor after the planing cycle. This is achieved, in accordance with the invention, by providing breaking tools which are mounted both on the fixed and on the movable supporting elements, between the vertically aligned cutting and breaking wedges, and are exchangeable and adjustable and break away the remaining mineral from the face.

The nozzle assembly provided in each cutting and breaking wedge and by means of which a mineral slab is separated from the face by a smooth cut, must be protected from the extracted mineral. On the other hand, the nozzle assembly must remain well accessible for maintenance. This is made possible, in accordance with the invention, by providing that the housing of the cutting and breaking wedges are each closed by a detachable base plate to which the nozzle assembly is secured.

The hydromechanical planer has a double function, namely both to undercut and to break away the mineral to be extracted. The seam is to be undercut continuously by a narrow incision and in such a way that the mineral becomes dislodged under a small pressure of the breaking wedge, that is without a breaking force worth mentioning.

By appropriately coordinating the undercutting and breaking operations, the power supply to the planer must be reducible to such an extent that every hard mineral can be mined by the planer economically.

This is possible only by making the nozzle jet fully effective and by operating it continuously. The most important work is thus performed by the nozzle. It is subject to wear and must therefore, by easily accessible for maintenance.

This problem is solved, in accordance with the invention, by providing a nozzle assembly consisting of a fixed part comprising a supply conduit for the cutting liquid, and a swinging part on which the nozzle is mounted in a detachable manner.

It is substantial for a fully effective operation of the nozzle assembly to insure continuous oscillatory motion of the swinging part of the assembly, and thereby of the nozzle, and a quite satisfactory transmission of this motion from the drive.

Damages and contamination of the nozzle are prevented, in accordance with the invention, by a removable protecting cover which is received in a recess of the bottom plate.

To insure a continuous and full utilization of the planer, the cutting and breaking heads must be brought into engagement with the seam in a shortest possible time and must be disengageable therefrom equally fast after the operation is performed. In accordance with the invention this is achieved by providing that the breaking wedges can be extended and retracted.

Upon accomplishing the dislodging cut in one direction, the planer must be capable of being reset within a minimum period of time for a cut in the opposite direction. This is obtained by providing a cutting and breaking head on both front sides, i.e. on either side of the planer body.

The planer operates so that while one breaking head is extended into its operative position, the other head remains in its retracted position.

Accordingly, it is an object of the invention to provide an improved hydromatic planer particularly for mining materials in a mining seam, which comprises a planer housing with at least one cutting and breaking head mounted on the housing and wherein each cutting head includes a first vertically arranged support member with a second support member mounted on the first for upward and downward movement in respect thereto and wherein adjustment means are connected between the first support member and the housing for adjustment of the first member upwardly and downwardly in respect to the housing and a second adjustment is provided for adjusting the second support member relative to the first, at least one first cutting and breaking wedge is mounted on the second support member for adjustable movement relative thereto and has a wedge shaped cutting edge disposed in a first plane for engagement with a mining seam in a first plane and at least one second cutting and breaking wedge is mounted on the first support member for movement relative thereto and has a wedge shaped cutting and breaking wedge disposed at substantially right angles to the first plane for operation in the first plane and wherein there are nozzle means associated with each of the cutting and breaking wedges which is capable of directing a fluid stream against the seam to make an incision therein.

A further object of the invention to provide a hydromatic planer which is simple in design, rugged in construction and economical to manufacture.

The various features of novelty which characterize the invention are pointed out with particularity in the claims annexed to and forming a part of this disclosure.

For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
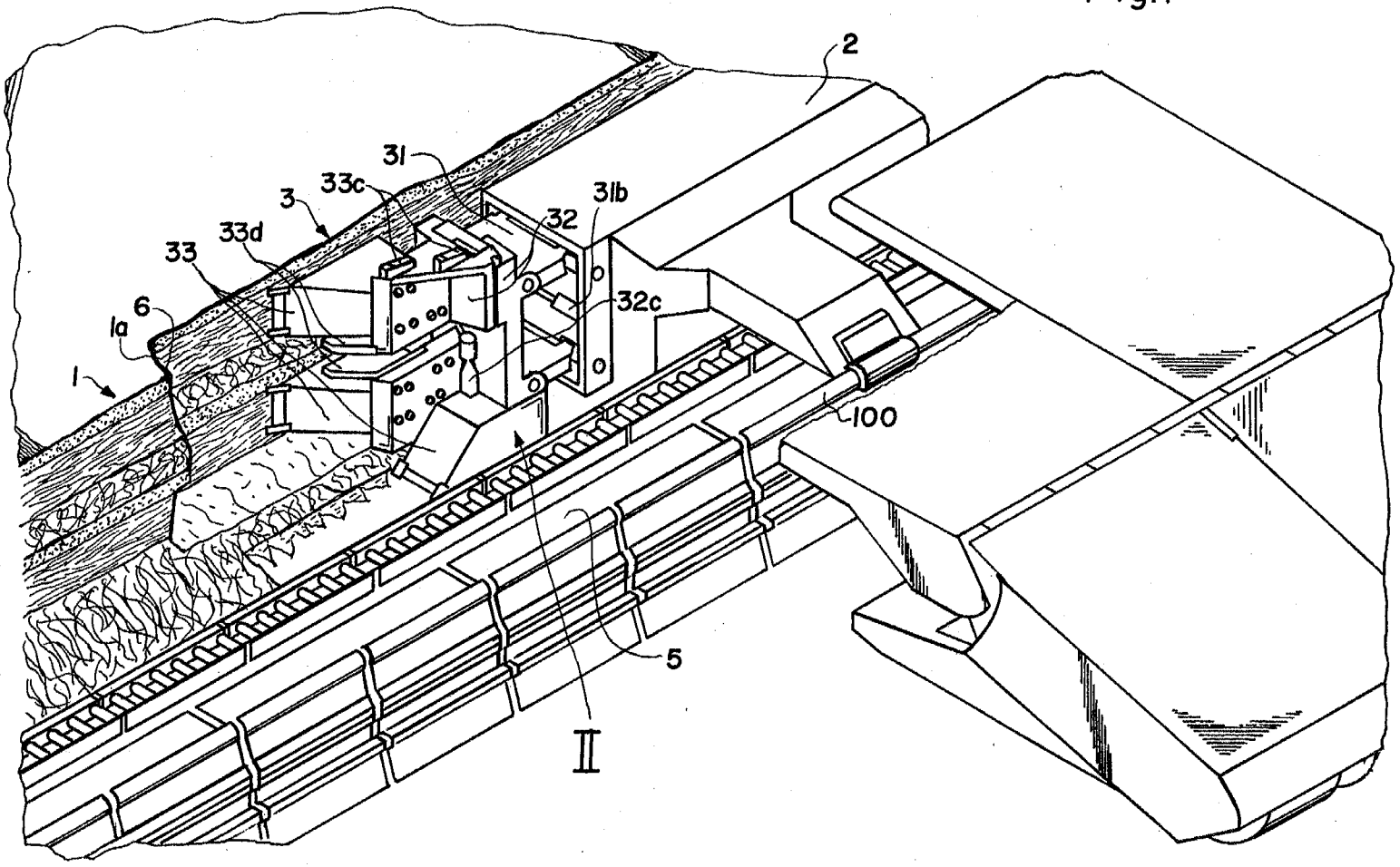
FIG. 1 is a partial top perspective view of a hydromechanical planer comprising a cutting and breaking head constructed in accordance with the invention.
Figure 2:
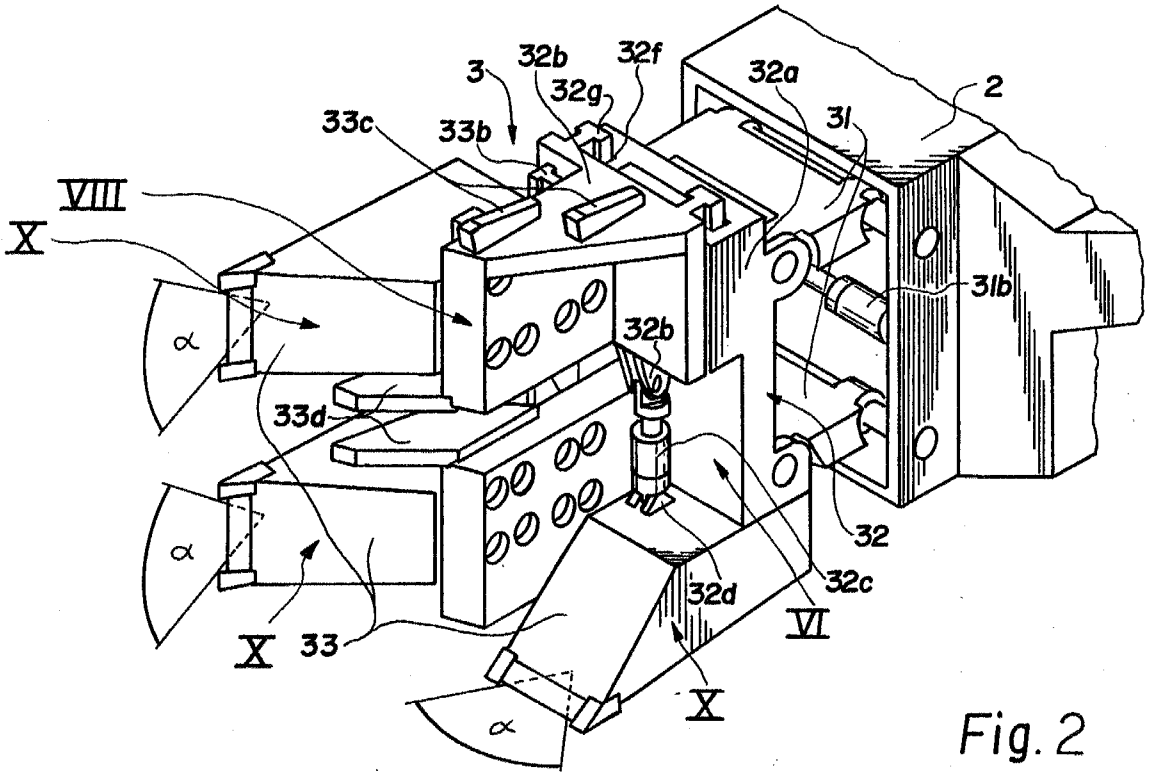
FIG. 2 is a detail of FIG. 1 indicated by arrow II in FIG. 1.

Referring to the drawings in particular, the invention embodied therein comprises a hydromatic planer particularly for mining materials in a mining seam generally designated 1. The planer includes a planer housing 2 which has two separate cutting and breaking heads namely a cutting and breaking head 3 disposed at one end of the housing 2 and a cutting and breaking head 4 disposed at the opposite end. The housing 2 as shown in FIG. 1 is guided on a guide rod structure 100 over a conveyor 5 and along the working seam 1 of the mine.

Figure 4:
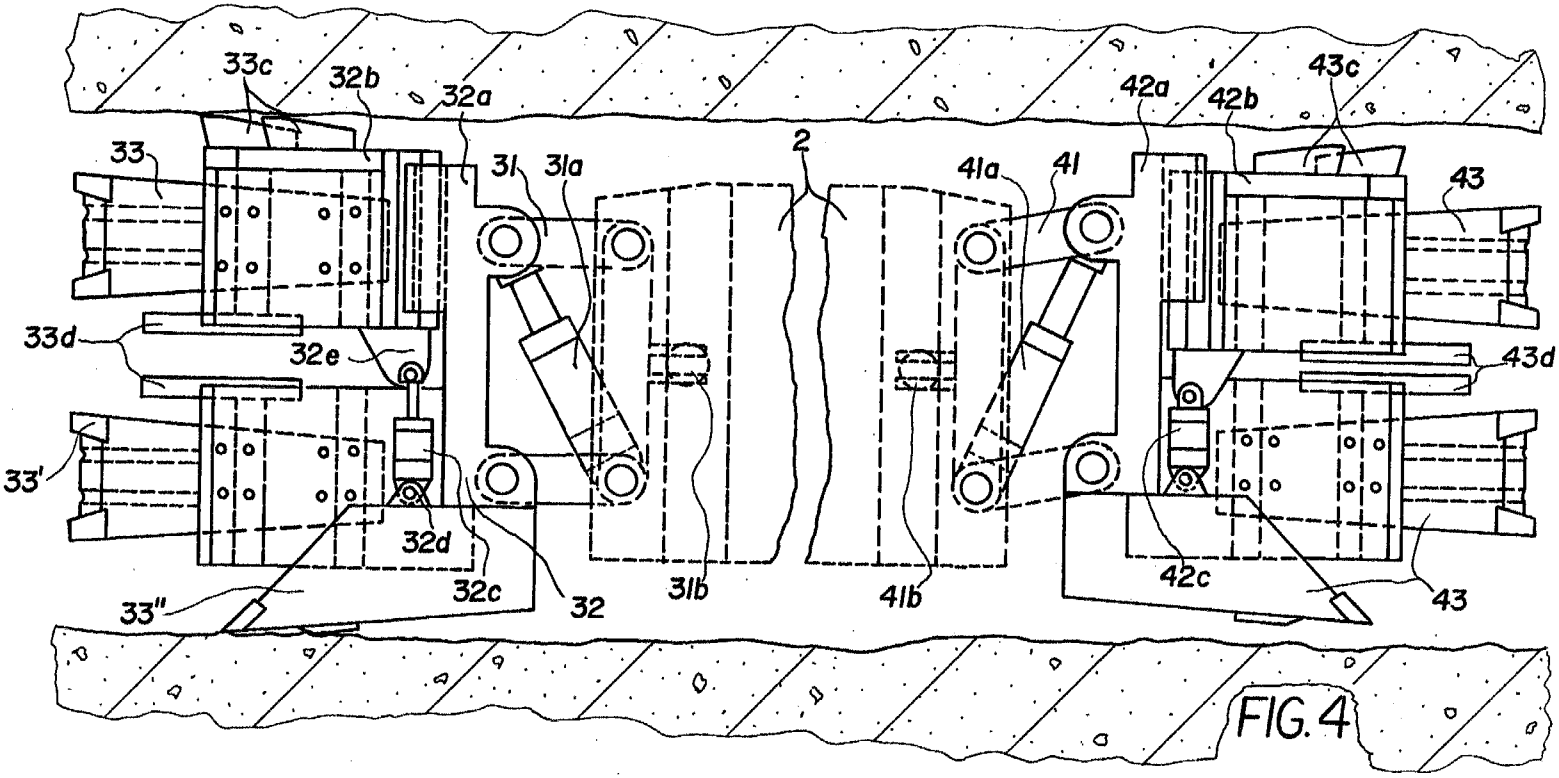
FIG. 4 is a side view of the planer as shown in FIG. 3.

In accordance with the invention, the planer 2 includes a first vertically arranged support member 32 which as shown in FIG. 4 includes a vertically extending portion **32*a* which is connected to the housing 2 by a parallel linkage 31 so that it may be shifted upwardly and downwardly by adjustment means 31*a* in the form of the fluid pressure operated piston and cylinder combination pivotly connected to the housing and to the support member 32*a*. A second support member 32*b* is mounted on the support member 32*a* for upward and downward movement relative thereto. A second support member 32 may be positioned in an adjusted position by means of a second adjustment means in the form of a fluid pressure operated piston and cylinder combination 32*c* connected between the second support member 32*b* and the first support member 32*a***.

Figure 10:
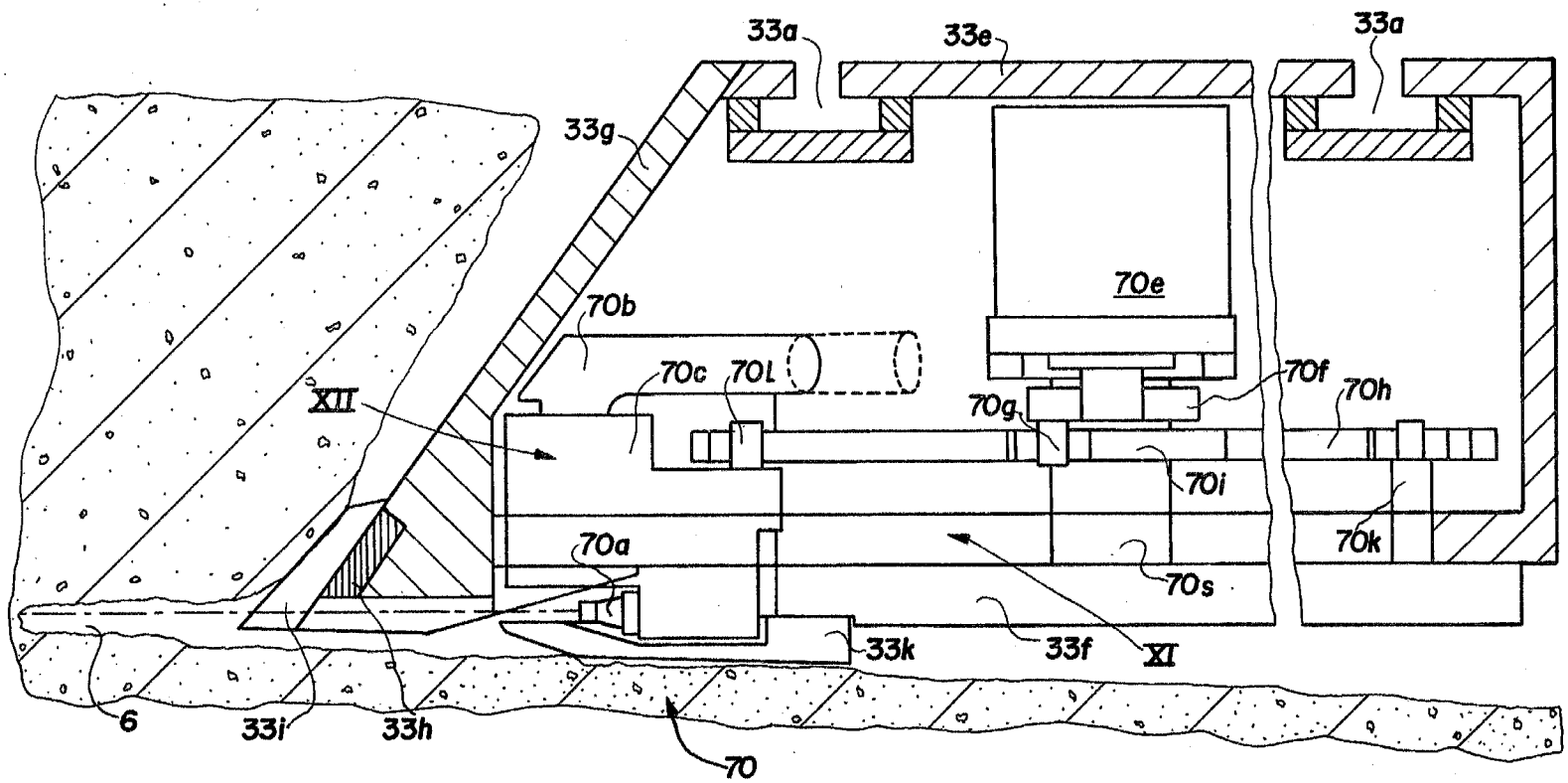
FIG. 10 is a sectional view of a detail of FIG. 2 indicated by arrow X in FIG. 2.
Figure 11:
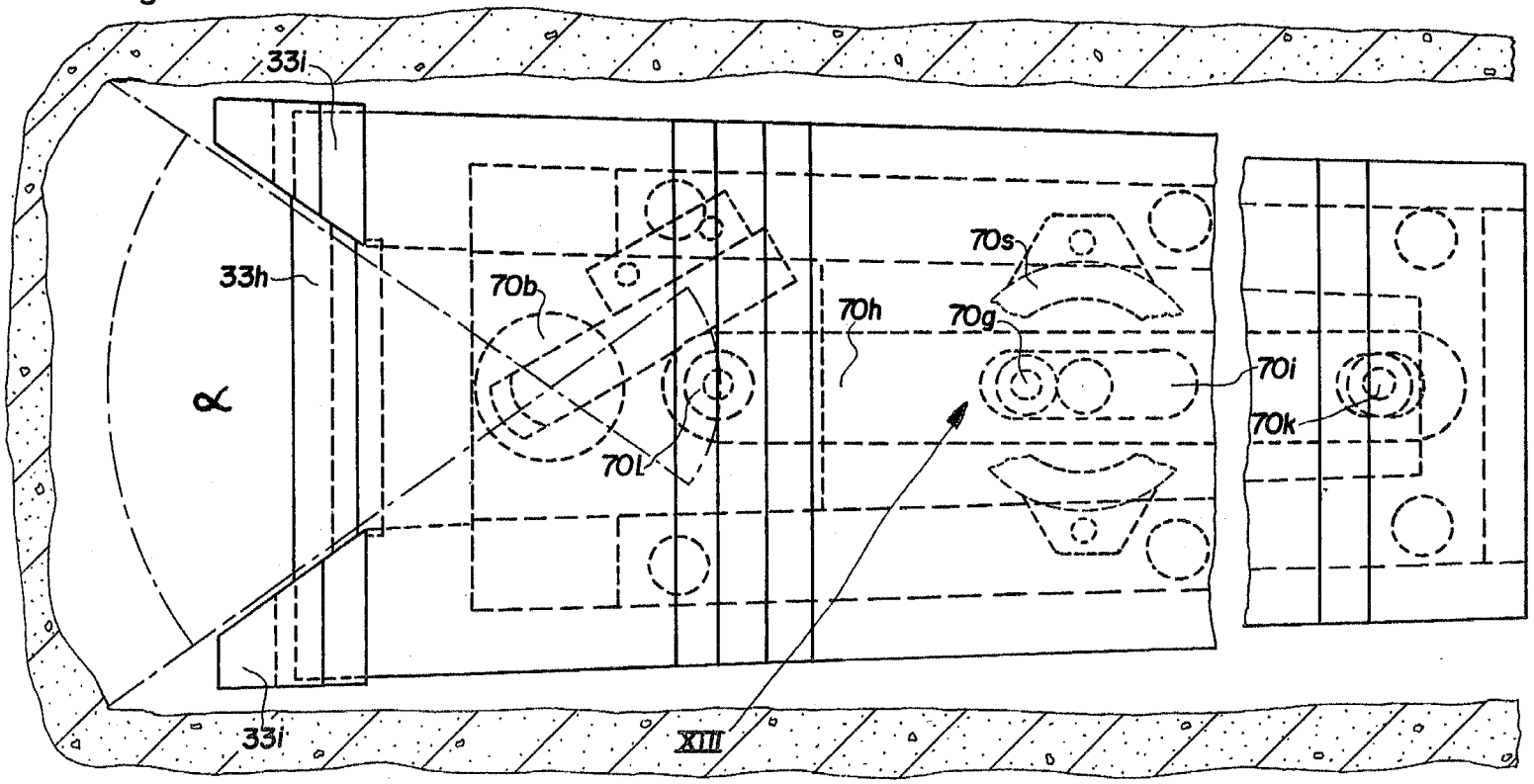
FIG. 11 is a top plan view of a detail of FIG. 10, indicated by arrow XI in FIG. 10.

As shown in FIG. 1, the mineral **1*a* of a worked seam 1 is undercut by the hydromechanical planer by means of a nozzle assembly 70 shown in detail in FIG. 10. The nozzle assembly 70 is mounted on each cutting and breaking head 3 and 4 and a nozzle 702 makes an incision or cut 6 into the seam (FIG. 10) by the forcing a fluid discharged by a nozzle 702. Thereafter a slab is broken away from the formation by means of respective cutting and breaking wedges 33 and 43 which also are mounted on each of the cutting and breaking heads 3 and 4. The slab material is transferred to conveyor means 5 away from the work fall of the seam 1**.

In the embodiment of FIGS. 2–5, the hydromechanical planer 2 is equipped with respective cutting and breaking heads 3 and 4 on each side, and the heads are connected to the planer body by means of respective parallelogram-like coupling elements or links 31, 41 extending between the heads 3 and 4 and the housing 2. The coupling elements 31 for head 3 and 41 for head 4 make it possible to adjust the cutting and breaking heads 3 and 4 in height.

The various parts for heads 3 and 4 are of similar construction and therefore only head 3 will be referred to in the following detailed description. The parts for head 3 are designed by numerals in the thirties and the identical parts for head 4 are referred to by corresponding numerals in the forties.

Coupling element 31 may also be adjusted in the horizontal direction by means of adjusting elements **31*b* so that planer 2** can adapt to the advance of the face.

Coupling element 31 and 41 are hinged to the cutting and breaking heads 3 and 4 respectively. Each head 3 and 4 comprises a supporting element 32 and cutting and breaking wedges 33.

The supporting element 32 is made in two parts, namely a fixed supporting element **32*a* and a supporting element 32*b***, movable relatively therein.

Figure 5:
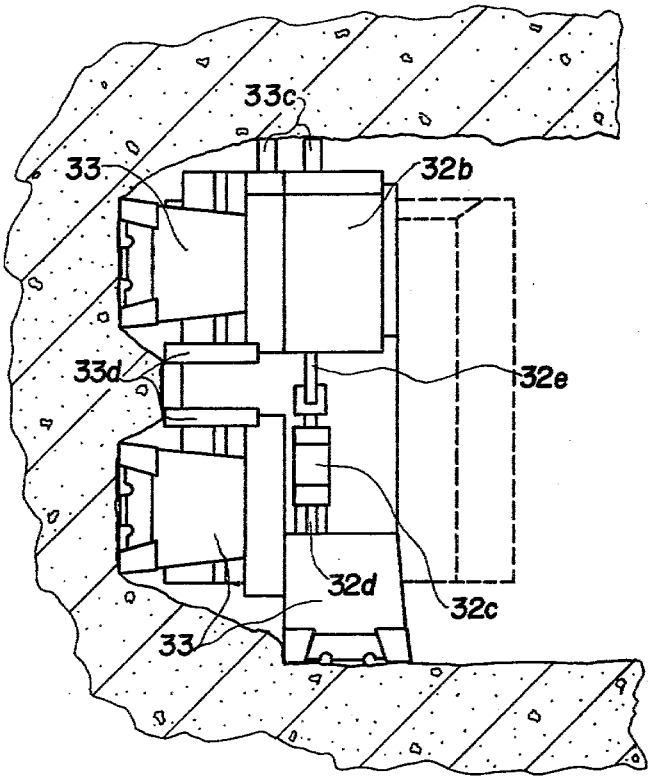
FIG. 5 is a front view of the planer as shown in FIG. 3.

One cutting and breaking wedge 33 is secured, in the upper part of planer 2, to the fixed supporting element **32*a* and another cutting and breaking wedge 33' of equal design is secured, in the lower part of planer 2, to the movable supporting element 32*b*. Further, a third cutting and breaking wedge 33'', 43 also of identical form is connected to the underside of the fixed supporting element 32*a* and extends close above the floor of the working space (FIG. 5). The fixed and movable supporting elements 32*a* and 32*b* respectively, are connected to each other for relative motion by means of adjusting elements 32*c*. For this purpose, adjusting element 32*c* is hinged to the fixed supporting element 32*a* at 32*d* and to the movable supporting element 32*b* at 32*e***.

Figure 3:
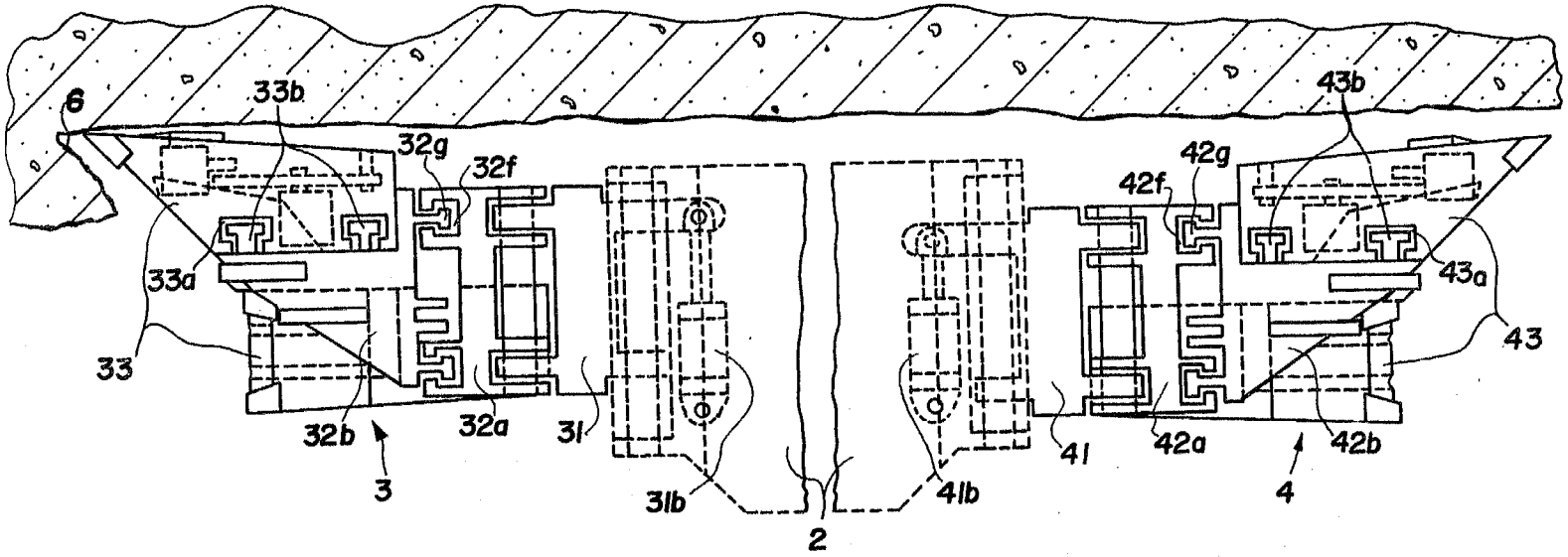
FIG. 3 is a top plan view of the planer.

During the adjustment, the projections **32*g*, of movable supporting element 32*b* slide in guides 32*f* of the fixed supporting element 32*a* (FIG. 3**).

During the operation of the planer, only one of the two cutting and breaking heads 3 and 4 is in working position at a time. In the shown example, breaking head 3 is in the operative position.

By means of adjusting element **31*a* (FIG. 4), coupling element 31 with supporting element 32** hinged thereto is lowered to the floor.

Simultaneously, movable supporting element **32*b* is lifted to the roof by means of adjusting element 32*c***.

This brings the cutting and breaking head 3 into contact with both the roof and the floor and the planer is ready for operation. In this position, the two cutting and breaking wedges 33' and 33'' secured to the movable supporting element **32*b* and to the fixed supporting element 32*a* respectively, are also adjustable in height, by means of guides 33*a* and corresponding clamping and guide elements 33*b* (FIG. 3**).

In the shown operative position of the planer (FIG. 4), cutting and breaking head 4 must be in its retracted position into which it is brought by means of adjusting element **42*c* of movable supporting element 42*b* by which it is disengaged from the roof, and by means of adjusting element 41*a* and coupling element 41 by which it is disengaged from the floor. This is made possible by providing that the stroke of adjusting element 42*c* is longer than that of adjusting element 41*a***.

This brings cutting and breaking head 4 out of contact with the roof and the floor. As soon as the planer has accomplished a cutting operation by means of cutting and breaking head 3, this head is retracted and cutting and breaking head 4 is brought into its operative position in the same way as described, to perform a cutting operation in the opposite direction.

FIG. 4 at the left hand side shows the operative position of cutting and breaking head 3, with the two cutting and breaking wedges 33, 33' positioned one above the other and with breaking tools **33*d* provided therebetween, for ripping the protruding central portion of the seam, as well as a tool 33*c* for ripping the mineral from the roof. Also cutting and breaking wedge 33''** is in an operative position for ripping the remaining mineral in the floor.

At the right hand side, FIG. 4 shows the planer 2 with its cutting and breaking wedges 43 and ripping tool **43*c*** disengaged from the roof and the floor.

Figure 8:
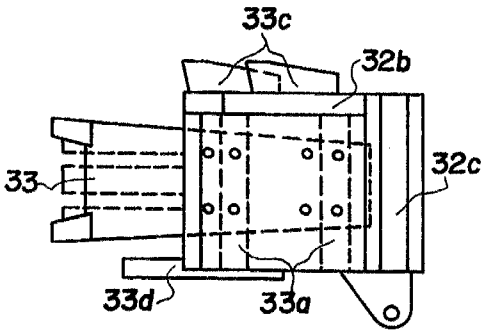
FIG. 8 is a side view of a detail of FIG. 2 indicated by arrow VIII in FIG. 2.
Figure 9:
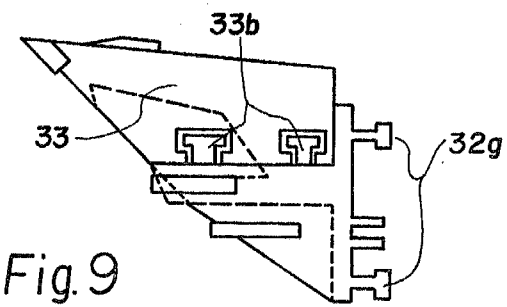
FIG. 9 is a top plan view corresponding to FIG. 8.
Figure 6:
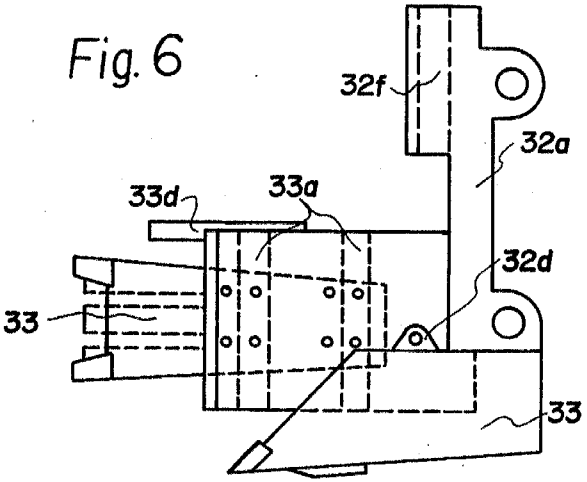
FIG. 6 is a side view of the detail of FIG. 2 indicated by arrow VI in FIG. 2.
Figure 7:
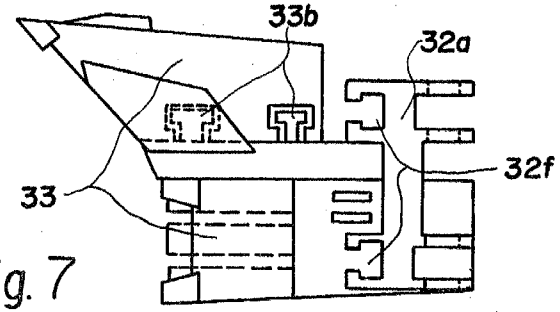
FIG. 7 is a top plan view corresponding to FIG. 6.

FIGS. 6–9 show the supporting elements 32 of the breaking tool 3 with the cutting and breaking wedges 33, 33' and 33'' secured thereto. FIGS. 6 and 7 show the relatively fixed supporting element **32*a* and FIGS. 8 and 9 show the movable supporting element 32*b* which is movable relative to supporting element 32*a***.

According to FIG. 10, all of the cutting and breaking wedges 33, 33' and 33'' of each cutting and breaking head 3 and 4 comprises a housing **33*e* with a front plate 33*g*, having a central breaking tool 33*h* and two lateral breaking tools 33*i* which are exchangably embedded in the front plate 33*g***.

Housing **33*e* is closed by a bottom plate 33*f* carrying the nozzle assembly 70**.

Figure 12:
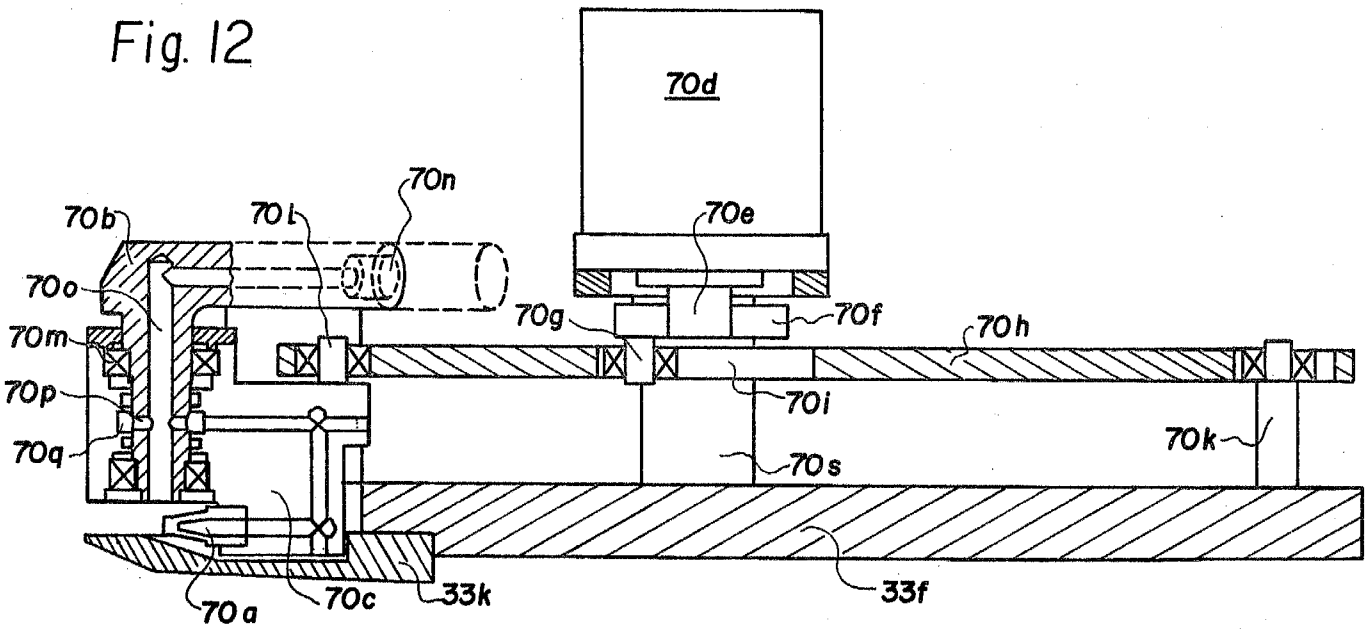
FIG. 12 is a sectional view of a detail of FIG. 10 indicated by arrow XII in FIG. 10.
Figure 13:
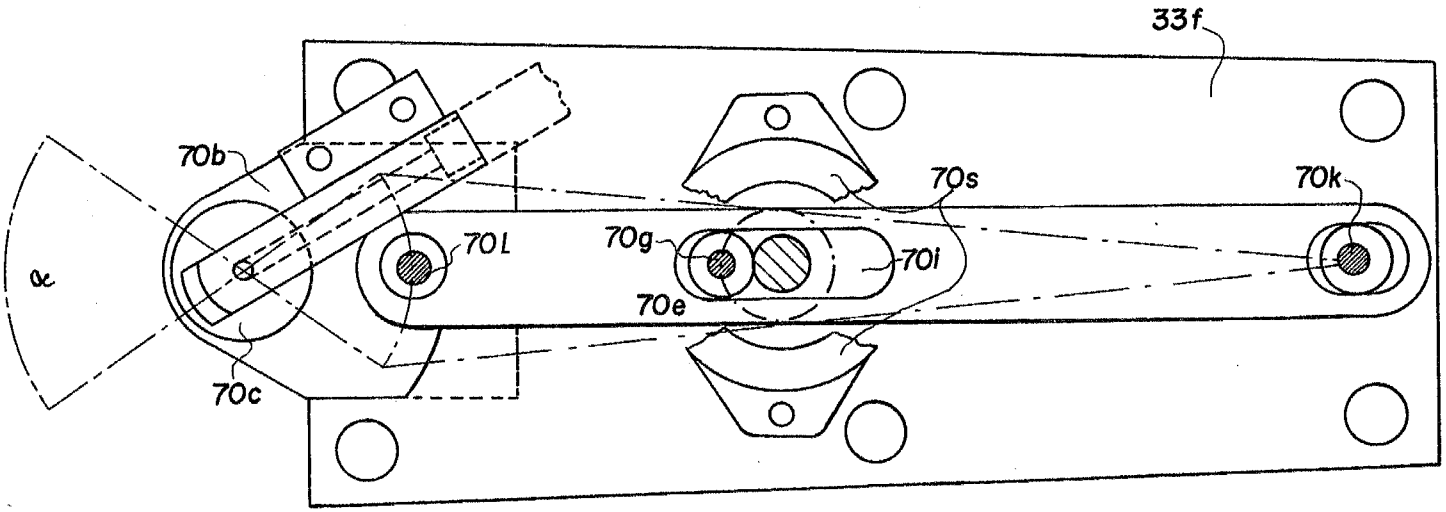
FIG. 13 is a top plan view of a detail of FIG. 11 indicated by arrow XIII in FIG. 11.

Nozzle assembly 70 is shown in FIGS. 10–13 and it comprises a fixed part **70*b* with supply connections for the high-pressure liquid, and a swinging or oscillatory part 70*c* (FIG. 12**).

An exchangeable nozzle **70*a* is secured to swinging part 70*c*. A swing drive 70*d* mounted on bottom plate 33*f*, by means of a pedestal 70*s*** is provided to produce the oscillatory motion at a high and adjustable frequency.

The rotary motion of swing drive **70*d* is transmitted through a drive shaft 70*e* to a rotary disc 70*f* carrying an eccentric pin 70*g*. Pin 70*g* is engaged in an oblong slot 70*i* provided in a coupling bar 70*h*, whereby the rotary motion of swing drive 70*a* is transformed into a pivotal motion of coupling bar 70*h* about its end pivot 70*k*. At the opposite side of coupling bar 70*h*, the pivotal motion is transmitted, through a pin 70*l* to the swinging part 70*c* connected thereto. Swinging part 70*c* performs its oscillatory motion about the fixed part 70*b* as its pivot (FIG. 12**).

Swinging part **70*c* is mounted on fixed part 70*b* by means of antifriction bearings 70*m***.

The high-pressure liquid is supplied to nozzle assembly 70 through a high-pressure line **70*n* connected to fixed part 70*b*, and is directed further through inner bore 70*o*. From the fixed part 70*b*, the high-pressure liquid passes into swinging part 70*c* through a crossbore 70*p* and an annular conduit 70*q* provided in the swinging part, wherefrom it is supplied to nozzle 70***a* through bores 70*b*.

The liquid jet from nozzle 70*a* is directed against the mineral to be dislodged by undercutting, and executes an oscillatory motion through a swing angle alpha (FIG. 11), in a plane which is perpendicular to the floor, whereby an incision 6 is produced (FIG. 10).

The swinging part 70*c* which is made in one piece, and nozzle 70*a* secured thereto, are closed on the underside by a cover 33*k* which is recessed in bottom plate 33*f*, 43*f*. Since in the shown embodiment, the ripping tool for the floor is designed as a cutting and breaking wedge 33''', 43''' and the planer 2 comprises two further cutting and breaking wedges 33', 43' and 33'', 43'' positioned one above the other, three nozzle assemblies 70 are provided on each side of the planer. Thus, device has six nozzle assemblies altogether.

While specific embodiments of the invention have been shown and described in detail to illustrate the application of the principles of the invention, it will be understood that the invention may be embodied otherwise without departing from such principles.

What is claimed is:

1. A hydromatic planer particularly for mining materials in a mining seam, comprising a planer housing, at least one cutting and breaking head mounted on said housing, each head including a first and vertically arranged support member, a second support member mounted on said first support member for upward and downward movement relative to said first support member, a first adjustment means connected between said first support member and said housing for adjusting said cutting and breaking head upwardly and downwardly relative to said housing, second adjustment means between said second support member and said first support member for adjusting said second support member upwardly and downwardly relative to said first support member, at least one first cutting and breaking wedge mounted on said second support member for adjustable movement relative to said second support member and having a wedge shaped cutting edge disposed in a first plane for engagement in the mining seam, and at least one second cutting and breaking wedge adjustably mounted on said first support member for movement relatively thereto having a wedge shaped cutting edge disposed in a second plane at substantially right angles to said first plane, and nozzle means associated with each of said first and second cutting and breaking wedges for directing a fluid stream against the seam to make an incision in the seam.

2. A hydromatic planer according to claim 1 wherein said nozzle means includes a nozzle which is mounted for oscillatory movement backwardly and forwardly so as to form a widened incision in the seam, said cutting and breaking wedges being of a size to engage into the seam and including tool means carried by said head in addition to said cutting and breaking wedges for breaking the material of the seam centrally of said heads and latterly thereof being capable of ripping the material to be extracted.

3. A hydromatic planer according to claim 1 wherein there are at least two cutting heads, on located on each side of said housing and including a conveyor disposed alongside said housing for conveying away the material cut away by said planer.

4. A hydromatic planer according to claim 1 wherein said first and second support members are movable upwardly and downwardly vertically for change in position thereof relative to the floor and roof of the seam.

5. A hydromatic planer according to claim 1 wherein said first vertically arranged support member has two vertically spaced pivots thereon and a pair of parallel linkages pivoted to said pivots of said support member to said housing, said first adjustment means comprising a fluid pressure operated piston and cylinder combination.

6. A hydromatic planer according to claim 1 wherein said first and second support members are mounted on said housing so that they may be displaced horizontally toward and away from the seam.

7. A hydromatic planer according to claim 1 wherein said first support member includes vertically extending guide ways defined therein, said second support member having projections engaged in said guide ways and being movable upwardly and downwardly therein.

8. A hydromatic planer according to claim 1 wherein said second element includes first and second projecting tools extending outwardly therefrom for engagement in the seam.

9. A hydromatic planer according to claim 1 wherein said second support member includes guides thereon, said first cutting and breaking wedge having a projection engaged in said guide and being movable upwardly and downwardly therein.

10. A hydromatic planer according to claim 1 wherein said at least one second cutting and breaking wedge includes a breaking wedge connected to the lower end of said first support member, said first support member being lowable with said at least one second cutting and breaking wedge to position it on the floor of the mining seam, said second cutting and breaking wedge being directed outwardly from said housing, said first cutting wedge having a cutting surface disposed at right angles thereto for engagement along the side of the seam.

11. A hydromatic planer according to claim 1 including a roof engagement tool mounted on said second support member in the position to be raised with said second support member into engagement with the roof.

12. A hydromatic planer according to claim 1 including at least one adjustable breaking tool mounted on said second support member and extending outwardly in front thereof in a position to engage and rip off a portion of the seam lying ahead of said associated cutting and breaking wedge.

13. A hydromatic planer according to claim 1 wherein each of said first and second cutting and breaking wedges comprise a housing having a detachable bottom plate and nozzle means comprising a nozzle assembly in said housing attached to said bottom plate.

14. A hydromatic planer according to claim 13 wherein said nozzle assembly comprises a fixed part with a cutting liquid connection, and a swinging part having a nozzle connected thereto swingably mounted on said fixed part.

15. A hydromatic planer according to claim 14 including a drive for said nozzle comprising a rotary shaft, an eccentric pin rotated by said shaft, a coupling bar having an elongated slot in which said pin is engaged to pivot said bar backwardly and forwardly, said bar being mounted on its opposite end on a pivot, said nozzle swinging bar being connected to said coupling bar and being oscillated thereby.

16. A hydromatic planer according to claim 15 including a removable cover mounted on the front of said housing protecting said nozzle.

17. A hydromatic planer according to claim 16 including means mounting said breaking wedges on said first and second members so that they may be extended and retracted.

18. A hydromatic planer according to claim 1 wherein said at least one first cutting and breaking wedge comprises an upper cutting and breaking wedge and a lower cutting and breaking wedge both mounted on said second support member, at least one of them being movable relative to the other.

19. A hydromatic planer according to claim 1 wherein said at least one second cutting and breaking wedge comprises a floor engaging wedge extending outwardly from said first support member.

* * * * *